US009145020B2

(12) United States Patent
Cupit

(10) Patent No.: US 9,145,020 B2
(45) Date of Patent: Sep. 29, 2015

(54) PRINTING APPARATUS AND METHOD OF PRINTING

(75) Inventor: James Cupit, Edwalton (GB)

(73) Assignee: Markem-Imaje Industries Limited, Nottingham (GB)

( * ) Notice: Subject to any disclaimer, the term of this patent is extended or adjusted under 35 U.S.C. 154(b) by 0 days.

(21) Appl. No.: 14/125,902

(22) PCT Filed: Jun. 7, 2012

(86) PCT No.: PCT/GB2012/051272

§ 371 (c)(1),
(2), (4) Date: Mar. 4, 2014

(87) PCT Pub. No.: WO2012/172311

PCT Pub. Date: Dec. 20, 2012

(65) Prior Publication Data

US 2014/0184718 A1 Jul. 3, 2014

(30) Foreign Application Priority Data

Jun. 16, 2011 (GB) ..... 1110202.7

(51) Int. Cl.

| | |
|---|---|
| ***B41J 2/35*** | (2006.01) |
| ***B41J 29/393*** | (2006.01) |
| ***B41J 2/21*** | (2006.01) |
| ***B41J 2/355*** | (2006.01) |

(52) U.S. Cl.

CPC ..... *B41J 29/393* (2013.01); *B41J 2/2139* (2013.01); *B41J 2/2142* (2013.01); *B41J 2/2146* (2013.01); *B41J 2/355* (2013.01)

(58) Field of Classification Search

USPC ..... 347/211, 195, 188, 182, 181, 180, 179; 400/120.05, 120.06, 120.09, 120.15

See application file for complete search history.

(56) References Cited

U.S. PATENT DOCUMENTS

| | | | |
|---|---|---|---|
| 2004/0146331 | A1 | 7/2004 | McNestry |
| 2004/0165025 | A1 | 8/2004 | Ishibashi |
| 2005/0078133 | A1 | 4/2005 | Molinet et al. |
| 2007/0195351 | A1 | 8/2007 | Mashtare et al. |
| 2009/0010498 | A1 | 1/2009 | Gaston et al. |

FOREIGN PATENT DOCUMENTS

| | | | |
|---|---|---|---|
| DE | 102008016538 | A1 | 10/2009 |
| EP | 1010531 | B1 | 2/2012 |
| GB | 2438649 | A | 12/2007 |

OTHER PUBLICATIONS

Application No. GB1110202.7, Search Report under Section 17, dated Oct. 14, 2011, 1 page.

International Search Report issued by European Patent Office dated Nov. 12, 2012, 4 pages.

Chinese Application No. 2012800290164, Translation of the Notification of the First Office Action, received Dec. 16, 2014, 7 pages.

*Primary Examiner* — Kristal Feggins

(74) *Attorney, Agent, or Firm* — Fish & Richardson P.C.

(57) ABSTRACT

A method of printing including testing the status of a printhead (12) having a plurality of printing elements (14) each of which is operable to transfer a marking medium from a web (16) to a substrate (18), wherein the method includes testing the status of each printing element (14), and providing a preview of an image (30) to be printed and, in the event that the print quality of the image is inadequate owing to the position of one or more damaged printing elements (14*a*, 14*b*) relative to the image (30) to be printed, adjusting the position of a component (30*a*, 30*b*) of the image (30) relative to the printhead (12) to improve the print quality.

17 Claims, 3 Drawing Sheets

PRINTING APPARATUS AND METHOD OF PRINTING

This invention relates to a printing apparatus for printing on a substrate and to a method of printing. More particularly, the invention relates to a printing apparatus which utilises a printing ribbon which includes a web carrying a marking medium, a printhead to remove marking medium from selected areas of the web so as to transfer the marking medium to the substrate to form an image, such as a picture, text or a barcode.

The invention particularly, but not exclusively, relates to a so-called thermal transfer printing apparatus in which there is provided a printhead which includes a plurality of thermal printing elements which are selectively energisable, so as to soften and remove pixels of marking medium from the web, and to transfer such pixels to the substrate. The printing elements are arranged in a line which extends in a direction which is substantially transverse to a direction of movement of the substrate relative to the printhead, and substantially transverse to a direction of movement of the web relative to the printhead. Printheads of this type are prone to wear, because the printing elements are in indirect contact with the substrate through the web. Such printheads are therefore susceptible to abrasive wear and impact damage. The printing elements also have a finite life so it is advantageous to detect their failure. The method of printing includes testing the status of each printing element of the printhead.

It is known to analyse the status or 'health' of a printing element of a thermal transfer printer, to determine whether or not each printing element is healthy and capable of warming and transferring a pixel of ink to a substrate. A known method of testing the status of printing elements involves a user examining sample images printed by the printhead, and assessing the print quality achieved. The quality of print may be improved by trial and error.

A disadvantage of this method is that the substrate(s) may be fast moving, difficult to access and/or expensive, meaning that rejected samples cost a significant amount. Additionally, failure to adequately test the print quality can lead to printed images not attaining required standards, for example the image may contain a barcode which is unreadable, leading to the recall of a packaged product.

In accordance with a first aspect of the invention, there is provided a method of printing including testing the status of a printhead having a plurality of printing elements each of which is operable to transfer a marking medium from a web to a substrate, wherein the method includes testing the status of each printing element, and providing a preview of an image to be printed and, in the event that the print quality of the image is inadequate owing to the position of one or more damaged printing elements relative to the image to be printed, adjusting the position of at least one component of the image relative to the printhead to improve the print quality.

An advantage of this method is that a user is alerted to the presence of damaged printing elements, and can take action to improve print quality without having to repair or replace the printhead. Furthermore, the user is able to preview the quality of the print without having to carry out one or more printing operations, thus avoiding wastage of carrier and substrate. The present invention reduces or eliminates the need to make repeated checks of printed samples.

The method may include providing a preview of the image which would be produced as a result of the adjustment.

The position of the entire image may be adjusted such that at least one damaged printing element falls outside a boundary of a component of the image.

Where the transfer printer is used to print images which are narrower than the width of the web, there is at least one portion of the web which is redundant during normal use. The position of the or each such portion of the web corresponds with one or more printing elements of the printhead, which are also usually redundant during normal use. This means that if one or more damaged printing elements are discovered during testing of the printhead, it may be possible to use some of these normally redundant elements instead of one or more damaged elements to carry out the desired printing operation, by adjusting the position of the image relative to the web. The image is thus offset relative to the printhead.

The method may include adjusting the position of the image in one of a first direction and a second, opposite direction relative to the printhead, wherein the first and second directions are substantially transverse to a direction of movement of the web and the substrate relative to the printhead.

The image may include more than one component and the method may include adjusting the position of at least one component relative to the or each other component, such that at least one damaged element falls outside a boundary of a component of the image.

The method may include automatic adjustment of the position of the at least one component of the image relative to the printhead, the automatic adjustment including determining a position of the or each component of the image relative to the printhead which minimises the number of damaged printing elements which would be positioned within a boundary of a component of the image during a printing operation, and displaying a preview of the image which would be produced as a result of the adjustment.

Adjusting the position of the entire image or components of an image relative to one another may be difficult for a user to achieve 'manually', as there are usually so many options available that it would be beyond the cognitive capability of the user to determine the optimum position of the or each image component to achieve the best possible print quality. The invention facilitates such manipulation of the image component(s) to accurately optimise print quality with little or no intervention by the user.

The method may include automatic adjustment of a component of the image relative to one or more other components of the image, the automatic adjustment including determining the optimum positions of the components of the image relative to one another so as to minimise the number of damaged printing elements used during a printing operation to produce the image, and the method may further include displaying a preview of the image which would be produced as a result of the adjustment.

The method may include providing two or more alternative arrangements of the at least one component of the image relative to the printhead, displaying a preview of the images which would be produced as a result of the alternative arrangements, and enabling the user to select a preferred arrangement.

The method may include providing a signal that the printhead includes one or more damaged printing elements only when the or each damaged element is positioned such that it would be required to transfer marking medium from the web to the substrate during a printing operation.

The method may include providing a signal to the user in the event that a cluster of damaged printing elements is identified within a boundary of the image to be printed.

The method may include stopping a printing operation in the event that the number of damaged printing elements positioned within a boundary of the image or a component of the image exceeds a predetermined threshold.

The method may include stopping a printing operation in the event that the size of a cluster of damaged printing elements positioned within a boundary of the image or a component of the image exceeds a predetermined threshold. The cluster size is defined as the number of failed printing elements over a specified length of printhead.

According to a second aspect of the invention, there is provided a test apparatus for testing the status of a printhead including a plurality of printing elements, the test apparatus including a controller and a display device, wherein the controller is operable to receive an input from each printing element, the input being indicative of the status of the respective printing element, and wherein the controller causes the display device to display a preview of an image to be printed on a substrate by the printhead, the preview showing the position of any damaged printing elements which have been identified relative to the image to be printed, the controller determining an optimum position of a component of the image relative to the printhead so as to optimise the quality of the image.

The controller may determine an optimum position of each component of an image including a plurality of components, relative to the printhead, so as to optimise the quality of the image.

The test apparatus may include an input device to enable a user to manually adjust the position of at least one component of the image relative to the printhead.

According to a third aspect of the invention, there is provided a printing apparatus including a test apparatus according to the second aspect of the invention and a printhead.

The printing apparatus may include a mechanism to advance a web carrying a marking medium relative to the printhead and a mechanism to advance a substrate to be printed relative to the printhead.

The invention will now be described, by way of example only, with reference to the accompanying drawings, of which:

Figure 1:
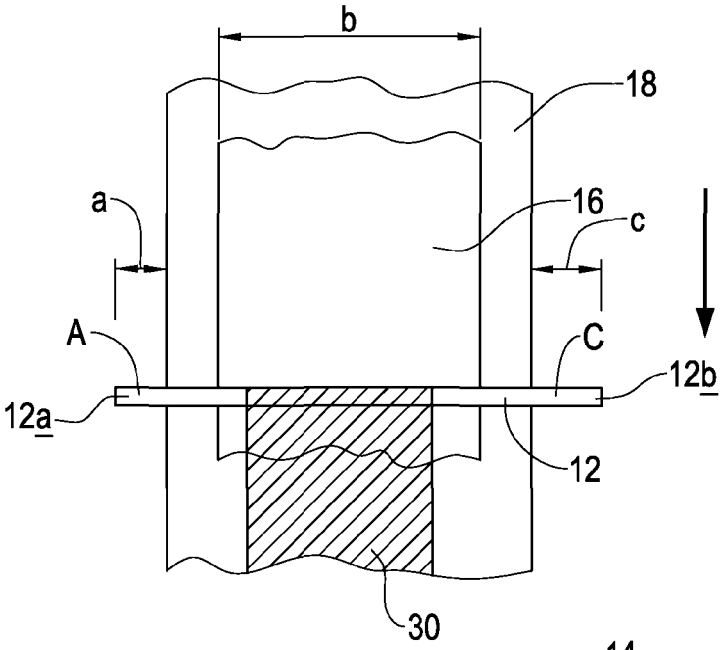
FIG. 1 shows a row of printing elements of a printhead of a printing apparatus adjacent a web carrying a marking medium, a substrate to be printed and a boundary of an image printed on to the substrate.
Figure 2:
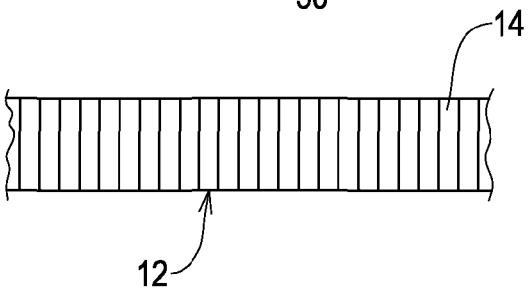
FIG. 2 shows an enlarged portion of the printhead showing individual printing elements.

Referring to FIGS. 1 and 2, there is shown a part of a printing apparatus 10. The printing apparatus 10 includes a printhead 12 which includes a plurality of printing elements 14. The printing elements 14 are arranged in a line, adjacent one another. The printhead 12 has a first end 12*a* and a second end 12*b*.

The printing apparatus 10 also includes a mechanism 15 for advancing a web 16 carrying a marking medium, for example a wax-based ink, relative to the printhead 12. The direction of movement of the web 16 relative to the printhead 12 is in a direction which is substantially transverse to the direction in which the line of printing elements 14 extends along the printhead. The printing apparatus 10 also includes a mechanism 17 for advancing the substrate 18 relative to the printhead 12, also in a direction which is substantially transverse to the direction in which the line of printing elements 14 extends along the printhead 12.

Thus, the printhead 12 is capable of printing pixels at various positions across the width of the substrate 18, as the substrate 18 is advanced past the printhead 12. The web 16 is advanced, so as to present unused pixels of marking medium to the printhead 12 for each printing operation. In the example shown, the printhead 12 is longer than the web 16 and the substrate 18 are wide; therefore a number of printing elements 14 at each end 12*a*, 12*b* of the printhead 12 are usually redundant during a printing operation. The distance 'a' between the first end 12*a* of the printhead and an edge of the web 16, the width of the web 'b' and the distance 'c' between the opposite edge of the web 18 and the second end 12*b* of the printhead 12 are shown in FIG. 1. It will be appreciated that there may be only one region of redundant printing elements 14, at one end 12*a*, 12*b* of the printhead 12, or that there may be no region of redundant printing elements 14.

Pixels of marking medium are transferable from the web 16 to the substrate 18 in rows, so as to form an image on the substrate 18. The image may include text and or figures, for example words, dates, barcodes, etc.

Figure 4:
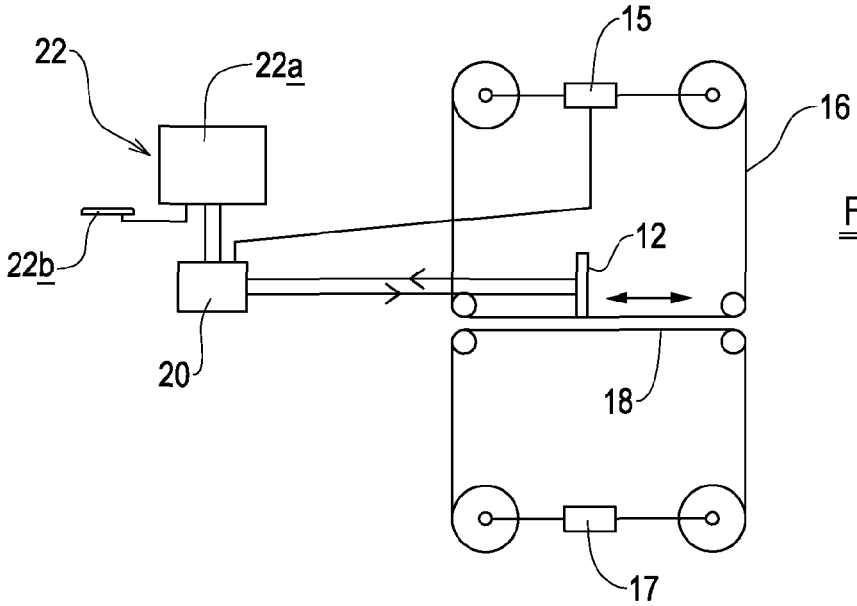
FIG. 4 is an illustrative view of a printing apparatus according to the invention.

Referring to FIG. 4, the printing apparatus 10 includes a controller 20 which controls the operation of the web advance mechanism 15 and may control the substrate advance mechanism 17. The web advance mechanism 15 and the substrate advance mechanism 17 are capable of advancing the web 16 and the substrate 18 respectively, in two directions relative to the printhead 12, i.e. in a forward direction and a reverse direction, as shown by the double headed arrow in FIG. 4. Both the forward and reverse directions are substantially transverse to the direction in which the line of printing elements 14 extends along the printhead 12. If the controller 20 does not control the substrate advance mechanism 17 then the controller 20 must include a device for detecting the movement of the substrate 18. This is typically provided by an encoder.

The controller 20 also controls the operation of the printing elements 14, to ensure that the correct printing elements 14 operate at the correct time so as to generate the required image.

Figure 3:
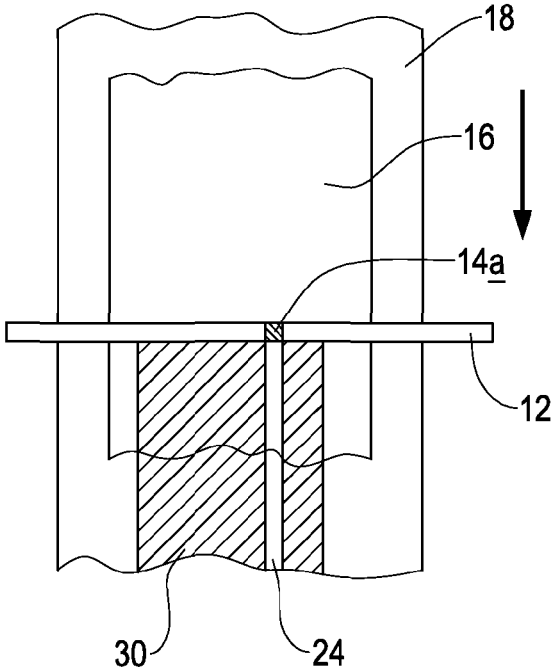
FIG. 3 shows a printhead with a damaged printing element, and the effect that the damaged printing element would have on a printing operation.

As can be seen from FIG. 3, a damaged printing element 14*a* may affect the quality of the image printed onto the substrate 18. An inoperative printing element 14*a* may cause a blank line 24 to appear in the image. The more damaged elements 14*a* are present in the printhead 12 the more the quality of the image is likely to be affected. A cluster of damaged printing elements 14*a* generally causes a more noticeable effect than a plurality of spaced apart damaged printing elements 14*a*.

The printing apparatus 10 includes a user interface 22. The user interface 22 includes a display 22*a*, for example a monitor, and an input device 22*b*, for example a keyboard, or touch-sensitive screen. The user interface 22 is communicable with the controller 20, such that commands or data input by a user may be transferred to other parts of the printing apparatus 10, for example the web advance mechanism 15, the substrate advance mechanism 17 and/or the printhead 12. It will be appreciated that the controller 20 may form a part of the user interface 22.

Furthermore, signals received by the controller 20 from the printhead 12, the web advance mechanism 15 and/or the substrate advance mechanism 17 may be passed to the user interface 22 via the controller 20. Thus, the display 22*a* is capable of displaying a preview of the image to be printed on to the substrate 18. The preview shows the effect that any damaged printing elements 14*a* that are present in the printhead 12 will have on the quality of the image.

The user interface 22 enables a user to input data to be included in the image which is to be printed on to the substrate 18, via the input device 22*b*. However, this is not an essential feature. The display 22*a* of the user interface 22 is operable to show a representation of the image to be printed on to the substrate 18.

The controller 20, the display 22*a* and the input device 22*b* co-operate as a test apparatus for the printhead 12.

In use, the user may optionally select the image to be printed and/or input data to be included in the image via the input device 22*b*. The display 22*a* preferably displays a preview of the image to enable the user to check and, if necessary, correct the image, before a printing operation is carried out by the printing apparatus 10. In order to compose the preview, the user interface 22 takes into account the position of the web 16 relative to the printhead 12, so that each pixel of the image is associated with the correct printing element 14 of the printhead. The or each redundant region of the printhead 12 is taken into account during this process. For example, the length of a redundant region of the printhead 12 at its first end 12*a* is taken into account by adding the number of printing elements 14 in the redundant region to the left hand side of the image preview when it is displayed on the display 22*a*. In some circumstances, it is necessary to align the right hand side of the image with the right hand side of the printhead 12 (the second end 12*b* in the Figures). In this case, the width of the image and the length of the printhead 12 must be taken into account when composing the preview, so as to correctly match the pixels of the image to the appropriate corresponding printing elements 14. If this was not taken into account, the preview would show a false representation of the effect of each damaged printing element 14*a*.

The status of each of the printing elements 14 is checked, and a signal is passed to the controller 20 to indicate whether any damaged printing elements 14*a* are present in the printhead 12. If no damaged printing elements 14*a* are present, or if the number of damaged printing elements 14*a* is lower than a predetermined amount, the controller 20 may provide an indication of this to the user via the user interface 22. The user may then command the printing apparatus 10 to begin printing via the user interface 22, and the web advance mechanism 15, the substrate advance mechanism 17 and the printhead 12 co-operate with one another to print the required image or images on to the substrate 18.

Alternatively, the controller 20 may automatically instruct the web advance mechanism 15, the substrate advance mechanism 17 and the printhead 12 to operate to transfer the desired image to the substrate 18, in the event that the number of damaged printing elements 14*a* is lower than a predetermined amount. The predetermined amount may be one damaged printing element 14*a*. The status of the printing elements 14 is checked continually during use of the printing apparatus 10. The controller 20 may cause the printing apparatus 10 to stop printing if the number of damaged printing elements 14*a* exceeds a predetermined amount.

Successive printing operations may be carried out to enable multiple images to be printed on to the substrate 18. The images may be identical to one another, or may be different from one another or include components which differ from printing operation to printing operation. For example in the case of a label bearing a serial number, the image may include a number which increases with every image that is printed, whilst the other components of the image remain the same. The substrate 18 may be a continuous roll of labels, for example, or, alternatively, may be individual labels or items arranged adjacent one another or a continuous reel of packaging material.

However, in the event that the controller 20 receives an indication that one or more printing elements 14 is damaged, or that the number of damaged printing elements 14*a* exceeds the predetermined amount, the controller 20 provides a signal to the user interface, to warn the user that print quality may be affected if the printing apparatus 10 is operated in its current configuration. The display 22*a* displays a preview of the image to be printed, so that the user can see the effect of the damaged printing elements 14*a*.

If the controller 20 receives an indication that a printing element 14*a* which is positioned in a region A of redundant printing elements 14, having a width a, or a region C of redundant printing elements 14, having a width c, is damaged, the controller 20 preferably does not provide a signal to the user interface 22, because only redundant printing elements 14 are affected, and hence the quality of the image will not be affected. Additionally or alternatively, the controller 20 does not provide a signal to the user interface 22 unless a predetermined number of damaged printing elements 14*a* has been reached or exceeded. The controller 20 may not provide a signal to the user interface 22 unless a predetermined number of damaged printing elements 14*a* has been identified either within a boundary of the image to be printed as a whole, or within boundaries of components of the image to be printed. Both of these features are optional, as the user may be informed of all damaged printing elements 14*a*, if desired.

In the event that the controller 20 receives an indication that the number of damaged printing elements 14*a* exceeds a predetermined amount, which number may be zero, the display 22*a* presents a preview of the next printing operation to the user. Thus the user can determine whether the quality of the printing is acceptable. The printing apparatus 10 operates in one of two main modes. The operation mode of the printing apparatus 10 may be pre-programmed or selected by the user.

Figure 5A:
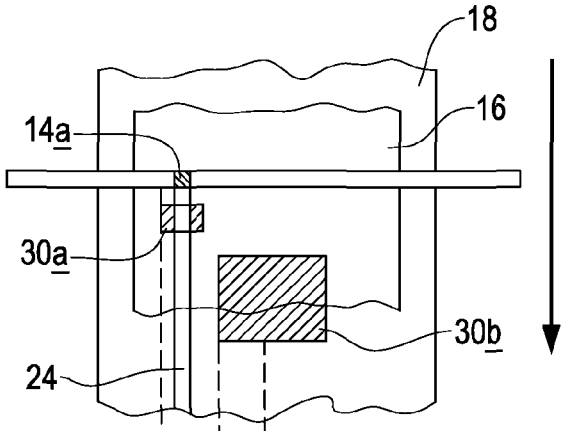
FIGS. 5A and 5B illustrate the adjustment of the position of the image relative to the printhead.
Figure 5B:
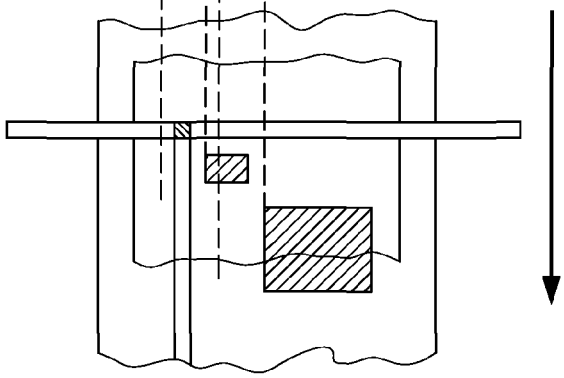

The first operational mode is 'whole-image-shift'. This mode is particularly appropriate if the width of the image to be printed is narrower than the width of the web 16. This mode of operation is shown in FIGS. 5A and 5B.

When checking the status of each of the printing elements 14, a damaged printing element 14*a* is identified in a position which would correspond with the position of the component 30*a* of the image 30, and hence is likely to have an effect on print quality of the image 30 such that it falls within the boundary of the component 30*a*. A preview of the effect of the damaged printing element 14*a* on print quality of the image to be printed is displayed to the user on the display 22*a*.

To avoid the damaged printing element 14*a* having an effect on print quality, the position of each of the components 30*a*, 30*b* of the image 30 is shifted relative to the web 18 and the printhead 12, so that the pixels of marking medium required to make up the component 30*a* of the image no longer correspond with the damaged printing element 14*a*. The position of the entire image 30 is adjusted to the right (in this example) by a distance x, which is sufficient for the damaged printing element 14*a* to be positioned to the left of the image 30 to be printed, i.e. outside the boundary of the image 30.

The example shown is simple, in that it includes only one damaged printing element 14*a*, and the image 30 includes only two simple components 30*a*, 30*b*. Of course, in reality an image to be printed 30 is likely to include a greater number of more complex components, and the number and density of damaged printing elements 14*a* present in the printhead 12 will affect whether whole image shift is appropriate and the specific adjustment of the image which is required to optimise print quality. The controller 20 preferably effects this adjustment automatically, to optimise print quality without requiring user input. However, it will be appreciated that the user may select an appropriate distance through which the image 30 should be moved, and in which direction.

A preview of the adjustment is displayed to the user on the display 22*a*, to enable the user to confirm that the print quality is adequate, and the position of the image 30 is acceptable, for example, the preview may be able to show features of the substrate 18 on to which the image 30 is to be printed, so that the user can ensure that the image 30 will not be printed outside a predetermined acceptable region.

Whole image shift is only appropriate in circumstances where the or each damaged printing element 14*a* is positioned sufficiently close to the edge of the affected component 30*a*, 30*b* of the image 30, that the whole image can be adjusted through a distance x which is sufficient to move the position of the damaged printing element 14*a* outside the boundary of each component 30*a*, 30*b* of the image 30, but is not so great that a part of the image 30 moves beyond an edge of the web 16.

Figure 6A:
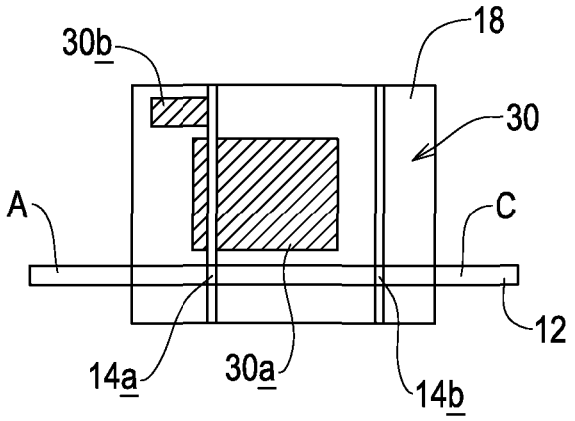
FIGS. 6A and 6B illustrate the adjustment of a component of an image to be printed relative to another component of the image and the printhead.
Figure 6B:
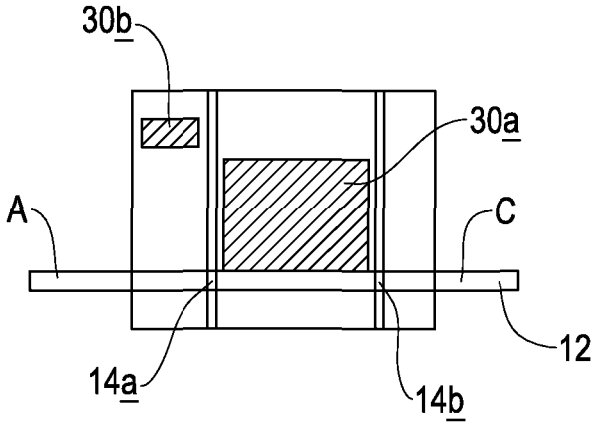

The alternative mode of operation is 'component shift'. In the event that a damaged printing element 14*a* is positioned such that it will affect print quality because its position coincides with the position of a pixel which makes up the image to be printed, the components of the image are movable relative to one another, such that the position of the damaged printing element 14*a* coincides with a line of pixels of marking medium which will not be required to be transferred to the substrate 18 during printing of the image. This mode of operation is shown in FIGS. 6A and 6B. The image 30 includes two components 30*a*, 30*b*. The printhead includes two damaged printing elements 14*a*, 14*b*. The position of the damaged printing element 14*a* on the printhead is such that it coincides with the position of the component 30*a* of the image. The damaged printing element 14*a* will not affect the print quality of the component 30*b*, as the damaged printing element 14*a* is positioned to one side of the component 30*b*. The damaged printing element 14*b* has no effect on the print quality of either component 30*a*, 30*b* as they are shown in FIG. 6A. The effect of the two damaged printing elements 14*a*, 14*b* on the print quality of the image to be printed is shown in a preview which is displayed to the user on the display 22*a*. The effects may be shown differently from one another, since the damaged printing element 14*a* affects the print quality of component 30*a*, but damaged printing element 14*b* does not affect the print quality of any image components, with the printing apparatus 10 in this configuration. Therefore, the effect of the damaged printing element 14*a* is preferably shown more prominently than the effect of the damaged printing element 14*b*. If no action was taken in relation to damaged printing element 14*b*, the print quality of the image would not be compromised.

If a predetermined number of damaged printing elements 14 are identified in positions which affect print quality, the controller 20 preferably prevents the web advance mechanism 15, the substrate advance mechanism 17 and the printhead from operating, so as to cancel or 'hold' the printing operation, pending further instructions from the user.

In this example, whole image shift is not suitable, because shifting the whole image 30 to the right relative to the web 16 by a sufficient amount to avoid any part of the component 30*a* coinciding with the damaged printing element 14*a* would cause component 30*b* to coincide with the damaged printing element 14*b*. Therefore whole image shift mode is not advantageous in this situation. Instead, the components 30*a*, 30*b* are movable relative to another, such that neither damaged printing element 14*a*, 14*b* coincides with either image component 30*a*, 30*b*, as shown in FIG. 6B. In this example, the component 30*a* has been moved to the right relative to the component 30*a* and the printhead 12, such that it is positioned between the two damaged printing elements 14*a*, 14*b*.

This mode of operation is preferably automatic, such that the controller 20 determines the optimum position of each of the components 30*a*, 30*b* of the image 30 relative to the damaged printing elements 14*a*, 14*b*, so as to optimise print quality. The relative positions of the image components 30*a*, 30*b* are displayed to the user on the display 22*a*, such that the user can verify that the adjusted relative positions of the image components 30*a*, 30*b* are acceptable. For example, certain image components 30*a*, 30*b* may have to be positioned in a certain place on the substrate 18, which may not be taken into account by the controller 20.

However, it will be appreciated that this mode of operation may alternatively be user-controlled. Further alternatively the mode may be automatic, but permit user manipulation of the components 30*a*, 30*b* of the image 30, for example to override or correct a suggestion made by the controller 20, or to make alternative suggestions.

Of course, there may be more than two components of the image 30, or there may only be one component of the image 30. Furthermore, there may be any number of damaged printing elements 14*a*, 14*b*, up to a limit which requires the replacement or repair of the printhead 12. The more components of the image 30 and the more damaged printing elements 14*a*, 14*b* that are present, the more difficult it is for a user to determine the optimum position of the image components relative to one another to optimise print quality. Therefore, and advantage of this system is that the user need not select the position of each of the components 30*a*, 30*b*, and need not carry out test prints to check print quality. Trial and error is eliminated from the process of maintaining print quality.

The size of one or more of the components of the image 30 may be adjustable so that the position of the component 30*a*, 30*b* does not coincide with a damaged printing element 14*a*, 14*b*. For example the size of the component 30*a* may be reduced, by reducing the size of the font used to present text, meaning that neither of the damaged printing elements 14*a*, 14*b* coincides with any part of the image.

It will be appreciated that it may not be possible to avoid the use of every damaged printing element 14*a*, 14*b* during a printing operation. However, the printing apparatus 10 is capable of ensuring that only the minimum number of damaged printing elements 14*a*, 14*b* are located in positions which will affect print quality.

The status testing of the printing elements 14 may be carried out continuously or intermittently during printing, such that if a printing element 14 becomes damaged during printing, the controller 20 provides an indication to the user via the user interface 22. The printing operation may be automatically stopped when a predetermined number of damaged printing elements 14*a* have been identified.

The printing apparatus 10 has been described as a continuous printer, wherein the printhead 12 is maintained stationary and the web 16 and the substrate 18 are moved continuously past the printhead 12 to print an image onto the substrate 18. However, the invention is also applicable to so-called intermittent printers where the substrate 18 to be printed is held stationary intermittently, and the printhead 12 is moved relative to the substrate 18 and the web 16, so as to transfer marking medium from the web 16 to the substrate 18.

Where used in this specification, the word 'damaged' in relation to a printing element is intended to mean inoperable, inactive or working at an inadequate level.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of printing including testing the status of a printhead having a plurality of printing elements each of which is operable to transfer a marking medium from a web to a substrate, wherein the method includes testing the status of each printing element, and providing a preview of an image to be printed and, in the event that the print quality of the image is inadequate owing to the position of one or more damaged printing elements relative to the image to be printed, adjusting the position of at least one component of the image relative to the printhead to improve the print quality, wherein the image includes more than one component and the method includes adjusting the position of at least one component relative to the or each other component whereby at least one damaged element falls outside a boundary of a component of the image.

2. A method according to claim 1 including providing a preview of the image which would be printed as a result of the adjustment.

3. A method according to claim 1 wherein the position of the entire image is adjusted relative to the printhead, such that the position of at least one damaged printing element falls outside a boundary of a component of the image.

4. A method according to claim 3 including adjusting the position of the image in one of a first direction and a second, opposite direction relative to the printhead, wherein the first and second directions are substantially transverse to a direction of movement of the web and the substrate relative to the printhead.

5. A method according to claim 1 including automatic adjustment of the position of the at least one component, the automatic adjustment including determining a position of one or more of the components of the image relative to the printhead which minimizes a number of damaged printing elements which would be positioned within a boundary of a component of the image during a printing operation, and displaying a preview of the image which would be produced as a result of the adjustment.

6. A method according to claim 5 including automatic adjustment of a component of the image relative to one or more other components of the image, the automatic adjustment including determining optimum positions of the components of the image relative to one another so as to minimize the number of damaged printing elements used during a printing operation to produce the image.

7. A method according to claim 1 including providing two or more alternative arrangements of the at least one component of the image relative to the printhead, displaying a preview of the images which would be produced as a result of the alternative arrangements, and enabling a user to select a preferred arrangement.

8. A method of printing including testing the status of a printhead having a plurality of printing elements each of which is operable to transfer a marking medium from a web to a substrate, wherein the method includes testing the status of each printing element, and providing a preview of an image to be printed and, in the event that the print quality of the image is inadequate owing to the position of one or more damaged printing elements relative to the image to be printed, adjusting the position of at least one component of the image relative to the printhead to improve the print quality, the method including automatic adjustment of the position of the at least one component of the image relative to the printhead, the automatic adjustment including determining a position of the at least one component of the image relative to the printhead which minimizes a number of damaged printing elements which would be positioned within a boundary of a component of the image during a printing operation.

9. A method according to claim 8 including providing a signal that the printhead includes one or more damaged printing elements only when a damaged element is positioned such that it would be required to transfer marking medium from the web to the substrate during a printing operation.

10. A method according to claim 8 including providing a signal to the user in the event that a cluster of damaged printing elements is identified within a boundary of the image to be printed.

11. A method according to claim 8 including stopping a printing operation in the event that a number of damaged printing elements positioned within a boundary of the image or a component of the image exceeds a predetermined threshold.

12. A method according to claim 8 including stopping a printing operation in the event that a size of a cluster of damaged printing elements positioned within a boundary of the image or a component of the image exceeds a predetermined threshold.

13. A test apparatus for testing the status of a printhead including a plurality of printing elements, the test apparatus including a controller and a display device, wherein the controller is operable to receive an input from each printing element, the input being indicative of the status of the respective printing element, and wherein the controller causes the display device to display a preview of an image to be printed on a substrate by the printhead, the preview showing the position of any damaged printing elements which have been identified relative to the image to be printed, and wherein the controller automatically determines an optimum position of a component of the image relative to the printhead so as to optimize the quality of the image, the automatic determination including determining a position of the component of the image relative to the printhead which minimizes a number of damaged printing elements which would be positioned within a boundary of a component of the image during a printing operation.

14. A test apparatus according to claim 13 wherein the controller determines an optimum position of each component of an image including a plurality of components, relative to the printhead, so as to optimize the quality of the image.

15. A test apparatus according to claim 13 including an input device to enable a user to manually adjust the position of at least one component of the image relative to the printhead.

16. A printing apparatus including a test apparatus for testing the status of a printhead including a plurality of printing elements, the test apparatus including a controller and a display device, wherein the controller is operable to receive an input from each printing element, the input being indicative of the status of the respective printing element, and wherein the controller causes the display device to display a preview of an image to be printed on a substrate by the printhead, the preview showing the position of any damaged printing elements which have been identified relative to the image to be printed, and wherein the controller automatically determines an optimum position of a component of the image relative to the printhead so as to optimize the quality of the image, the automatic determination including determining a position of the component of the image relative to the printhead which minimizes a number of damaged printing elements which would be positioned within a boundary of a component of the image during a printing operation.

17. A printing apparatus according to claim 16 wherein the printing apparatus includes a mechanism to advance a web carrying a marking medium relative to the printhead and a mechanism to advance a substrate to be printed relative to the printhead.

* * * * *